US006027358A

United States Patent [19]

Lai et al.

[11] Patent Number: 6,027,358

[45] Date of Patent: Feb. 22, 2000

[54] CARD EDGE CONNECTOR WITH BOARD RETENTION MEANS

[75] Inventors: Ching-Ho Lai, Tao-Yuan Hsien; Wen-Chun Pei, Taipei, both of Taiwan

[73] Assignee: Hon Hai Precision Ind. Co., Ltd., Taipei Hsien, Taiwan

[21] Appl. No.: 08/998,588

[22] Filed: Dec. 29, 1997

[30] Foreign Application Priority Data

Dec. 27, 1996 [TW] Taiwan ..... 85220265

[51] Int. Cl.[7] ..... H01R 13/639

[52] U.S. Cl. ..... 439/327

[58] Field of Search ..... 439/327, 630, 439/631, 636, 637, 326, 347, 260, 262, 372

[56] References Cited

U.S. PATENT DOCUMENTS

| | | | |
|---|---|---|---|
| 5,514,002 | 5/1996 | Cheng et al. | 439/326 |
| 5,650,917 | 7/1997 | Hsu | 361/759 |
| 5,902,143 | 5/1999 | Pan et al. | 439/327 |

*Primary Examiner*—Steven L. Stephan
*Assistant Examiner*—Eugene G. Byrd

[57] ABSTRACT

An electrical card edge connector for electrically connecting daughter boards of different thickness to a circuit board, comprises an insulative housing having a slot for receiving the daughter board therein, and a pair of spaced towers respectively adjacent to opposite ends of said slot wherein each tower further includes a pair of spaced rails for guiding the insertion of the daughter board into the slot, and a receiving portion defined above the rails by an interior wall and a pair of spaced stop walls. A rotatable first retention means is located at a top end of each tower for rotatably moving to vertically and releasably retain the daughter board inserted into the slot. A second retention means includes an attachment portion for retaining the second retention means within the receiving portion of each tower, and a pair of spaced spring arms supported by the stop walls to horizontally and elastically clamp the inserted daughter board therebetween. By means of the first and second retention means, daughter boards of different thickness are provided with sufficient and reliable multi-directional retention within the slot of the housing.

18 Claims, 4 Drawing Sheets

CARD EDGE CONNECTOR WITH BOARD RETENTION MEANS

BACKGROUND OF THE INVENTION

1. Field of The Invention

The present invention relates to an electrical connector for electrically connecting a daughter board to a circuit board, and particularly to a card edge connector for providing the daughter board with multi-directional retention.

2. The Prior Art

Conventional card edge connectors for use with a computer system usually utilize a normal engaging force from each of a plurality of contacts thereof to retain a daughter board inserted into an elongated slot of an insulative housing of the connector. The slot defines a plurality passageways arranged in rows on opposite sides thereof to respectively receive said contacts therein. However, when the computer system is subject to an external vibration, the normal engaging force of the contacts is not capable of providing the daughter board received in the connector with reliable and sufficient retention, which may possible cause an electrical disengagement between the circuit board and the daughter board resulting in a signal transmission error within the computer system. Such card edge connectors are disclosed in U.S. Pat. Nos. 4,795,374, 4,826,441, 4,842,538, 4,846,729, 4,869,672 and 5,026,292.

Additionally, Taiwan Paten Application No. 82,206,344 discloses a pair of opposite retention bars respectively located adjacent to opposite ends of the elongated slot to retain an inserted daughter board. However, the force arm provided by each retention bar is too short to stably support the inserted daughter board. U.S. Pat. Nos. 4,832,619 and 4,990,097 further disclose a pair of opposite towers for use with a compact daughter board located close to opposite ends of the slot of the connector. Each tower defines a groove with two opposite sidewalls for receiving one of opposite lateral edges of the inserted daughter board, but the sidewalls lacks elasticity to sufficiently clamp daughter boards of different thickness therebetween. U.S. Pat. Nos. 4,973,270, 5,013,264, 5,211,571 and 5,242,312 disclose a pair of an elastic retention bar(s) is/are integrally formed adjacent to at least one tower in the connector to elastically clamp the inserted daughter board. However, to some connectors providing the integral retention bars with the insulative housing, the methods for manufacturing the same require the use of multi-molds in molding process which becomes overly complicated. Furthermore, some retention bars with excessive elasticity may result in an unreliable electrical engagement through an undesired vibration as mentioned above. The above mentioned conventional connectors generally lack a vertical retention mechanism with respect to the inserted daughter board to ensure that the daughter board is accurately oriented within the slot and electrically engaged with the contacts therein. Other types of card edge connectors for retention with the daughter board are disclosed in Taiwan Patent Application Nos. 82,206,344, 84,210,361 and 84,213,255, and U.S. Pat. Nos. 4,204,737, 4,349,273, 4,781,612, 4,804,334, 4,826,447, 4,850,891, 4,898,540 and 4,990,097.

Accordingly, to resolve the above disadvantages, an object of the present invention is to provide a card edge connector with a first vertical retention means and a second horizontal retention means for providing an inserted daughter board with sufficient, multi-directional retention.

Another object of the present invention is to provide a card edge connector with a horizontal retention means which includes a pair of spring arms located above a pair of rails and each supported by a corresponding stop wall thereby providing a pair of spring arms with proper elasticity to clamp the daughter board therebetween.

The present invention is submitted in accordance with an improvement to a co-pending patent application Ser. No. 08/774,913 filed on Dec. 27, 1996.

SUMMARY OF THE INVENTION

According to an aspect of the present invention, a card edge connector for electrically connecting daughter boards of different thickness to a circuit board, mainly comprises an insulative housing having a slot for receiving a bottom edge of the daughter board therein, a plurality of passageways arranged in rows on opposite walls of the slot for receiving a number of contacts to electrically engage the inserted daughter board, and a pair of spaced towers respectively located adjacent to opposite ends of said slot wherein each tower further includes a pair of spaced rails for guiding the insertion of the daughter board into the slot, and a receiving portion defined above the rails and consisting of a first cavity and a second cavity. The first cavity is further defined by an interior wall and a pair of spaced stop walls. A first retention means is capable of rotatably moving with respect to a pivotal hole vertically extending through a top end of each tower for vertically and releasably retaining the inserted daughter board. A second retention means includes an attachment portion arranged with a plurality of barbs for retaining the second retention means within the second cavity of the receiving portion of each tower, and a pair of spaced spring arms respectively supported by the stop walls of the first cavity to horizontally and elastically clamp the inserted daughter board therebetween. By means of the first vertical retention means and second horizontal retention means, daughter boards of different thickness are provided with sufficient and reliable multi-directional retention within the slot of the housing.

DETAILED DESCRIPTION OF THE PREFERRED EMBODIMENT

Figure 1:
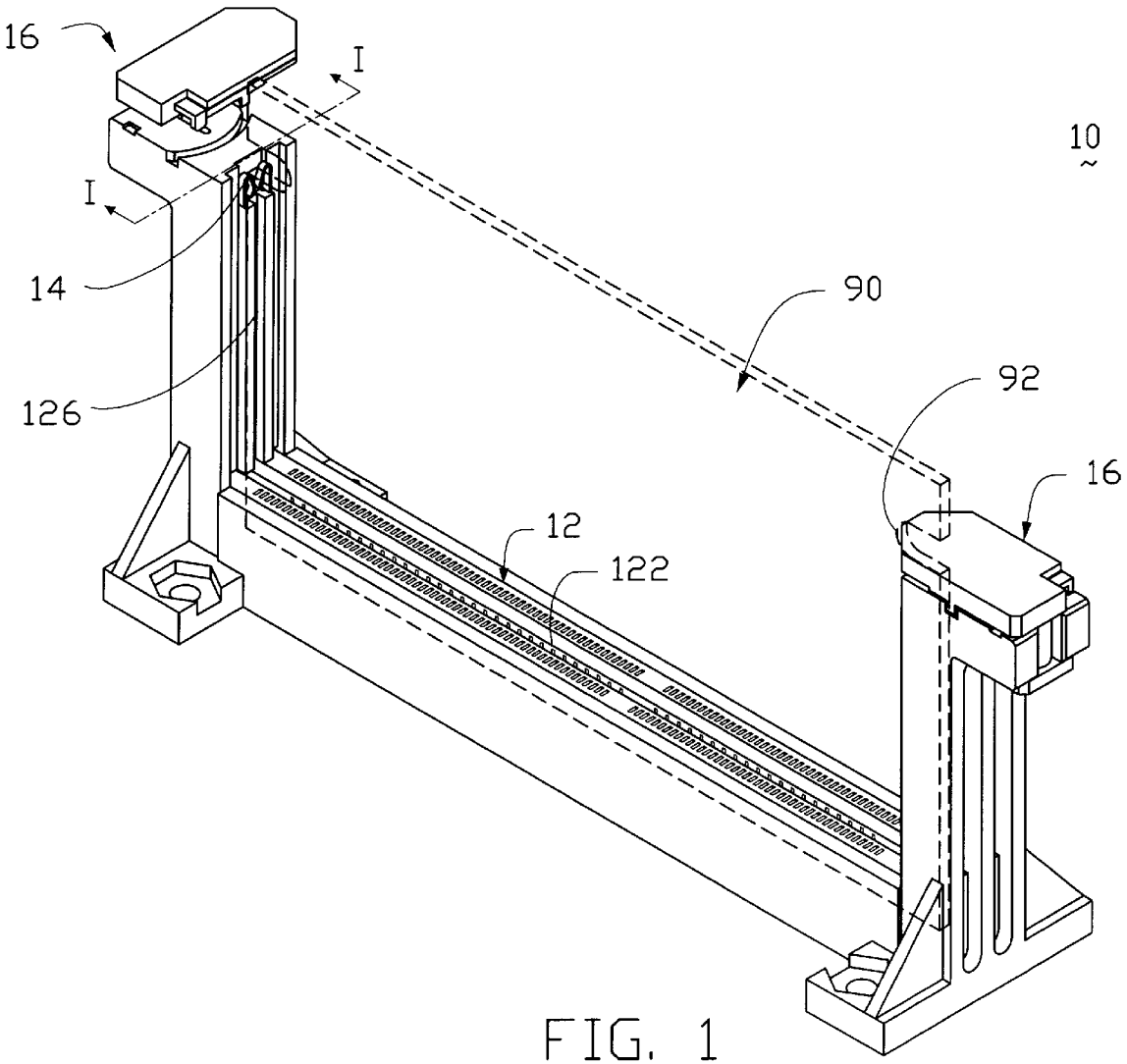
FIG. 1 is a perspective view of a card edge connector in accordance with the present invention illustrating an inserted daughter board drawn in dotted lines.
Figure 2:
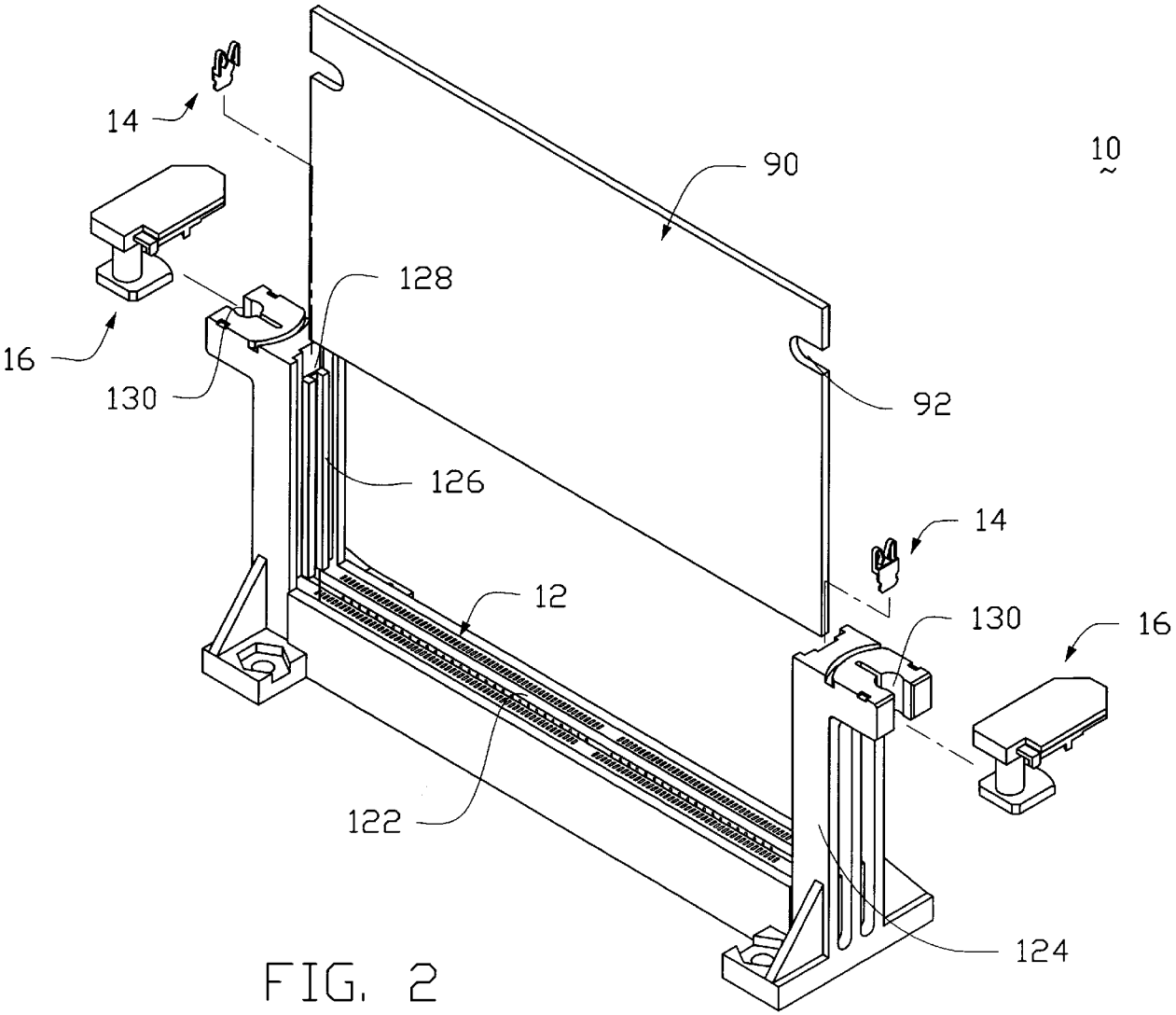
FIG. 2 is an exploded view of the card edge connector in accordance with the present invention.

References will now be made in detail with regard to the preferred embodiment of the present invention. An electrical card edge connector (10) as shown in FIGS. 1–2 for electrically connecting an exterior heightened daughter board (90) or the like to a circuit board (not shown), includes an insulative housing (12) which integrally forms therewith an elongated slot (122) and a pair of opposite heightened towers (124) respectively located at opposite ends of the slot (122) wherein the slot (122) receives a bottom edge of the daughter board (90) therein. A plurality of passageways (not labeled) are respectively arranged in rows in each opposite lateral wall of the slot (122) and receive a number of contacts (not shown) therein which project inside the slot (122) to electrically engage a corresponding plurality of conductive pads (not shown) formed along the bottom edge of the daughter board (90).

Figure 4:
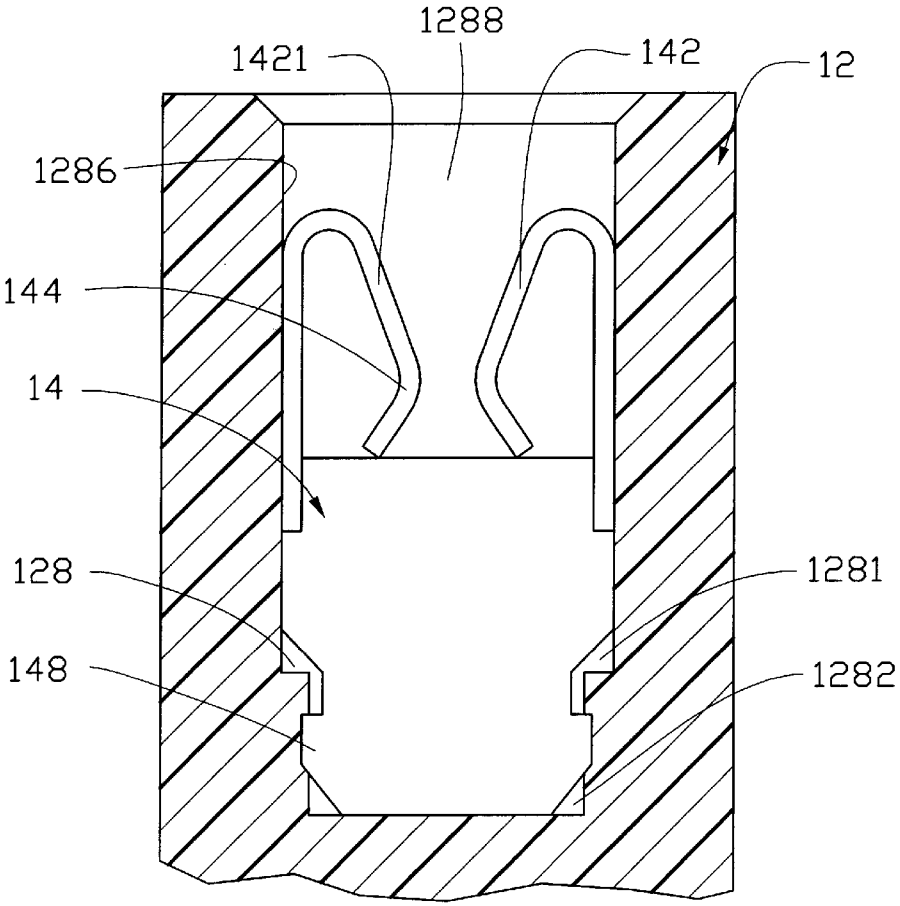
FIG. 4 is a partial cross-sectional view taken along line I—I of the card edge connector of FIG. 1.

Each heightened tower (124) includes a pivotal hole (130) vertically extending through a top end thereof for cooperating with a first retention means (16) to allow the first retention means (16) to pivot above the pivotal hole (130) along a clockwise/counterclockwise direction. The rotatable first retention means (16) is capable of releasably and vertically latching with a notch (92) defined in each opposite lateral edge of the daughter board (90). The detailed structure of the first retention means (16) and the pivotal hole (130) of the heightened tower (124) have been disclosed in the co-pending patent application Ser. No. 08/774,913 filed on Dec. 27, 1996 and will not be repeated in the present application. A pair of spaced rails (126) vertically extend along an inside wall of each tower (124) and are aligned with said slot (122) wherein a space (not labeled) separating the pair of rails (126) is slightly wider than the thickness of a generic daughter board for compliance with different thickness of daughter boards. As shown in FIG. 4, a receiving portion (128) shaped like a notch and adjacent to the top end of the tower (124) is formed above the pair of rails (126) to communicate with the space between the rails (126). The receiving portion (128) consists of a first cavity (1281) and a second cavity (1282) having a width less than that of the first cavity (1281). The first cavity (1281) further defined by an interior wall (1288) and two opposite stop walls (1286) adjacent to the interior wall (1288).

Figure 3:
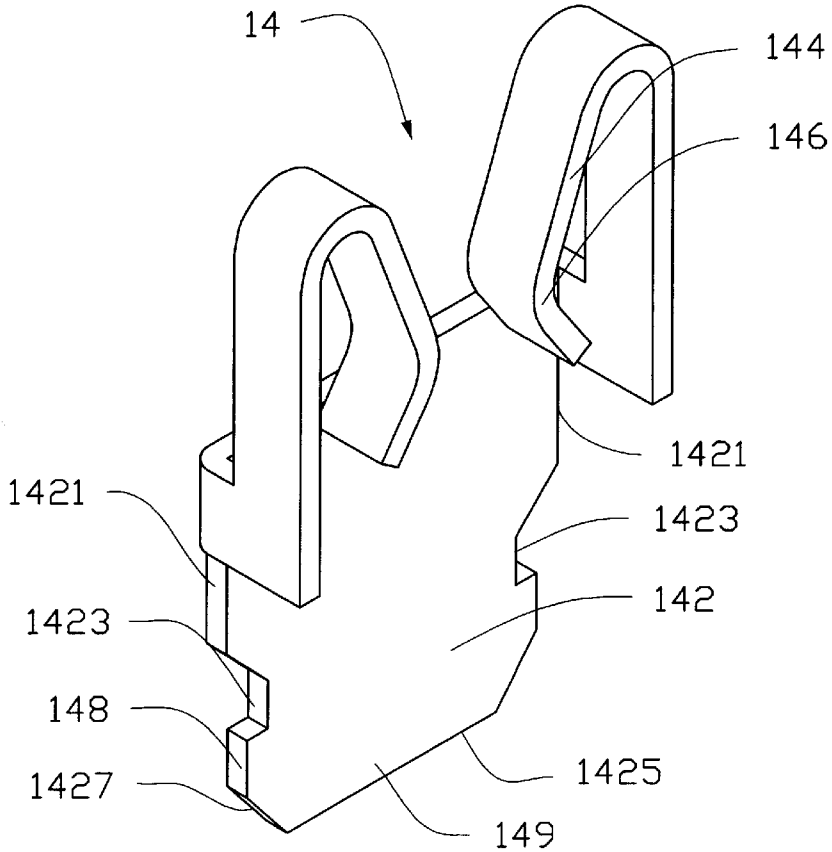
FIG. 3 is a perspective view of a second retention means of the card edge connector in accordance with the present invention.

A second retention means (14) as shown in FIG. 3, consists of a planar base portion (142), an attachment portion (149) and a pair of opposed and spaced spring arms (144) wherein the width of the attachment portion (149) is substantially less than that of the base portion (142) for complying with the width of the second cavity (1282) of the receiving portion (128). The attachment portion (149) formed below the base portion (142) for secure retention in the receiving portion (128) of the housing (12), includes a bottom end (1425) of which either of opposite first lateral edges (1423) forms a barb (148) and an inclined surface (1427) used for guiding the insertion of the attachment portion (149) into the receiving portion (128). The spring arms (144) are respectively perpendicularly bent with regard to opposite second lateral edges (1421) of the base portion (142) whereby each spring arm (144) extends upward from the corresponding second lateral edge (1421) to form an U-shaped section thereof (not labeled) for providing elasticity. Then the U-shaped section further extends downward in a specific inclined angle to define a bent engaging section (146) which is spaced apart from that of the other spring arm (144).

In assembly, as shown in FIGS. 2 & 4, by means of guidance of the inclined surfaces of the second retention means (14), the attachment portion (149) of the second retention means (14) can be downward inserted through the first cavity (1281) in the receiving portion (128) of the corresponding tower (124), until the bottom end (1425) of the second retention means (14) abuts against a bottom wall (not labeled) in the second cavity (1282) of the receiving portion (128). Meanwhile, the barbs (148) of the attachment portion (149) retentively interfere with opposite walls in the second cavity (1282) for securely retaining the whole second retention means (14) within the receiving portion (128) of the housing (12). And, each spring arm (144) rearward abuts against the corresponding stop wall (1286) in the first cavity (1281), and the base portion (142) abuts against the interior wall (1288) of the first cavity (1281) in the back thereof.

As shown in FIG. 2, the daughter board (90) is inserted into the slot (122) of the connector (10) by means of a space defined between the pair of spring arms (144) of the second retention means (14) of each tower (124) (shown in FIG. 4) and the rails (126) of the towers (124) respectively guiding the lateral edges of the daughter board (90). It is noted that although the spring arms (144) of the second retention means (14) of each tower (124) provide daughter boards of different thickness with elastic retention, the elasticity of the spring arms (144) are restricted by the rails (126) and the stop walls (1286) of the receiving portion (128) from being excessive. Because the rails (126) with a slightly wider space therebetween can avoid daughter boards of different thickness from being seriously vibrated, and the stop walls (1286) supporting the corresponding spring arms (144) can further prevent the spring arms (144) from being excessively compressed by the daughter board (90). Therefore, the spring arms (144) of the second retention means (14) of each tower (124) are capable of horizontally clamping daughter boards of different thickness therebetween with proper elasticity. In comparison with the methods of making the retention bars of prior art, the spring arms (144) of the second retention means (14) provided by the present invention are easily fabricated by a stamping process. The base portion (142) abutting against the interior wall of the receiving portion (128) in the back thereof, can be further designed to abut against the corresponding lateral edge of the daughter board (90) in the front thereof when the daughter board (90) is inserted into the slot (122).

Additionally, the first retention means (16) of each tower (124) can be rotated to cooperate with the notch (92) of the daughter board (90) thereby vertically retaining the daughter board (90) inserted into the slot (122). Consequently, it is understood that by means of cooperation of the first retention means (16) and second retention means (14), daughter boards of different thickness are provided with sufficient and reliable multi-directional retention within the slot (122) of the housing (12).

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

Therefore, person of ordinary skill in this field are to understand that all such equivalent structures are to be included within the scope of the following claims.

We claim:

1. An electrical connector for electrically connecting daughter boards of different thickness to a circuit board, comprising:

an insulative housing having a slot for receiving a bottom edge of the daughter board, a plurality of passageways arranged in rows in opposite walls of the slot for receiving a number of contacts therein to electrically engage a plurality of rows of conductive pads formed on said bottom edge of the daughter board, and a pair of spaced towers respectively adjacent to opposite ends of said slot and vertically extending with regard to a surface of the circuit board on which the connector is mounted wherein each tower includes a pivotal hole extending vertically through a top end thereof, a first retention means rotatably moving with respect to the pivotal hole to vertically and releasably retain the inserted daughter board, and a second retention means located below the first retention means to horizontally and elastically retain the daughter board which is vertically inserted into the slot along a longitudinal axis of each tower, said second retention means further including a base portion from which a spring arm perpendicularly extends.

2. The electrical connector as described in claim 1, wherein the first retention means cooperates with a notch defined in one of opposite lateral edges of the daughter board to vertically retain the daughter board.

3. The electrical connector as described in claim 1, wherein each tower further includes a receiving portion adjacent to said top end of the tower to retentively receive the second retention means therein.

4. An electrical connector for electrically connecting daughter boards of different thickness to a circuit board, comprising:

an insulative housing having a slot for receiving a bottom edge of the daughter board, a plurality of passageways arranged in rows in opposite walls of the slot for receiving a number of contacts therein to electrically engage a plurality of rows of conductive pads formed on said bottom edge of the daughter board, and a pair of spaced towers respectively adjacent to opposite ends of said slot and vertically extending with regard to a surface of the circuit board on which the connector is mounted wherein each tower includes a receiving portion having at least a cavity defined with opposite stop walls; and a horizontal retention means retained within the cavity of the receiving portion of each tower and forming at least a spring arm thereon to elastically retain the daughter board which is vertically inserted into the slot along a longitudinal axis of each tower via the cavities thereof wherein the spring arm is supported in the back thereof by one of the stop walls of the receiving portion thereby avoiding excessive deformation of the spring arm, and having an engaging portion extending toward the other of said stop walls for engagement with a lateral edge of the daughter board.

5. The electrical connector as described in claim 4, wherein a vertical retention means is located at a top end of each tower and rotatably move to vertically and releasably retain the inserted daughter board.

6. The electrical connector as described in claim 4, wherein when the horizontal retention means elastically retain the inserted daughter board, the spring arm of the horizontal retention means in each tower can elastically engage a corresponding lateral edge of the daughter board.

7. The electrical connector as described in claim 4, wherein the cavity of the receiving portion of each tower further includes an interior wall formed between the stop walls.

8. The electrical connector as described in claim 7, wherein the horizontal retention means further includes a base portion from which the spring arm perpendicularly extends.

9. The electrical connector as described in claim 8, wherein the base portion abuts against the interior wall of the receiving portion.

10. The electrical connector as described in claim 9, wherein when the horizontal retention means elastically retain the inserted daughter board, the lateral edge of the daughter board abuts against the base portion of the horizontal retention means in the receiving portion of each tower.

11. The electrical connector as described in claim 4, wherein the horizontal retention means is retained within the cavity of the receiving portion of the tower by means of a plurality of barbs thereof.

12. An electrical connector for electrically connecting daughter boards of different thickness to a circuit board, comprising:

an insulative housing having a slot for receiving a bottom edge of the daughter board, a plurality of passageways arranged in rows in opposite walls of the slot for receiving a number of contacts therein to electrically engage a plurality of rows of conductive pads formed on said bottom edge of the daughter board, and a pair of spaced towers respectively adjacent to opposite ends of said slot and vertically extending with regard to a surface of the circuit board on which the connector is mounted wherein each tower includes a pair of spaced rails for guiding the insertion of the daughter board into the slot, and a receiving portion defined above the rails and having at least a cavity defined with opposite stop walls; and a horizontal retention means formed with at least a plurality of barbs for retaining the horizontal retention means in the cavity of the receiving portion of each tower, and a spring arm thereon supported in the back thereof by one of the stop walls of the receiving portion to elastically engage the inserted daughter board thereby avoiding excessive deformation of the spring arm and having an engaging portion extending toward the other stop wall for engagement with the daughter board when the daughter board is vertically inserted into the slot of the housing along the rails of each tower via the cavities thereof.

13. The electrical connector as described in claim 12, wherein a space separating the rails communicates with the cavity of the receiving portion.

14. A retention means for retaining daughter boards of different thickness within an insulative housing of an electrical connector which includes a pair of opposite towers each having a receiving portion for receiving the retention means therein, comprising:

a planar base portion;

a pair of opposite spring arms for elastically clamping the inserted daughter board therebetween, perpendicularly bent with regard to opposite lateral edges of the base portion, and extending toward each other until defining a space between for guiding the passage of the daughter board therethrough wherein each spring arm is formed with an engaging portion for elastically engaging the inserted daughter board;

an attachment portion formed below the base portion for retaining the retention means within the receiving portion of the housing.

15. The retention means as described in claim 14, wherein the receiving portion of the housing consists of a first cavity and a second cavity having a width less than that of the first cavity.

16. The retention means as described in claim 15, wherein the base portion is received within the first cavity, and the attachment portion is retentively received within the second cavity.

17. The retention means as described in claim 15, wherein the spring arms of the retention means respectively rearward abut against two opposed and spaced stop walls which define the first cavity.

18. The retention means as described in claim 14, wherein the attachment portion forms a plurality of barbs.

* * * * *